United States Patent [19]

Remington

[11] Patent Number: 4,677,832

[45] Date of Patent: Jul. 7, 1987

[54] LUGGAGE LATCHING SYSTEM

[75] Inventor: Richard C. Remington, Pompton Plains, N.J.

[73] Assignee: Kidde, Inc. (Presto Lock Company Division), Garfield, N.J.

[21] Appl. No.: 850,073

[22] Filed: Apr. 7, 1986

Related U.S. Application Data

[63] Continuation of Ser. No. 524,691, Aug. 19, 1983, abandoned, which is a continuation of Ser. No. 240,848, Mar. 5, 1987, abandoned.

[51] Int. Cl.[4] ..... E05B 65/52

[52] U.S. Cl. ..... 70/67; 70/69; 70/312; 190/119; 292/30; 292/53; 292/244

[58] Field of Search ..... 70/66, 67, 69–71, 70/63, 64, 68, 72–76, 312, 304, 315–317; 190/28; 292/30, 53, DIG. 48, 244, 245, 127; 150/6; 190/119, 120, 100, 121

[56] References Cited

U.S. PATENT DOCUMENTS

| | | | |
|---|---|---|---|
| 259,601 | 6/1882 | Swanson | 292/30 |
| 596,164 | 12/1897 | Irwin | 70/304 |
| 886,708 | 5/1908 | Lau et al. | 70/66 |
| 1,090,736 | 3/1914 | Martin | 70/70 |
| 1,112,706 | 10/1914 | Koch | 70/70 |
| 2,161,519 | 6/1939 | Loftin et al. | 70/70 X |
| 2,967,418 | 1/1961 | Donald | 70/71 |
| 3,135,105 | 6/1964 | Brody | 190/28 |
| 3,204,436 | 9/1965 | Nemsky | 70/63 |
| 3,330,389 | 7/1967 | Kaplan | 190/121 X |
| 3,393,539 | 7/1968 | Gehrie | 70/71 |
| 3,555,860 | 1/1971 | Atkinson | 70/71 X |
| 3,677,042 | 7/1972 | Atkinson | 70/312 X |
| 3,938,630 | 2/1976 | March | 190/24 |
| 3,961,505 | 6/1976 | Gehrie et al. | 70/66 |
| 4,259,856 | 4/1981 | Wingert | 70/70 |
| 4,263,794 | 4/1981 | Sutliff | 70/70 |
| 4,273,368 | 6/1981 | Tanaka | 292/53 |
| 4,281,525 | 8/1981 | Bako | 70/71 |
| 4,356,712 | 11/1982 | Bako | 70/69 |
| 4,363,226 | 12/1982 | Remington et al. | 70/70 |

FOREIGN PATENT DOCUMENTS

| | | | |
|---|---|---|---|
| 0017539 | 3/1980 | France | 70/71 |
| 1102 | of 1872 | United Kingdom | 190/114 |
| 2094878 | 9/1982 | United Kingdom | 70/69 |
| 2146695 | 4/1985 | United Kingdom | 70/69 |
| 2146694 | 4/1985 | United Kingdom | 70/69 |
| 2146693 | 4/1985 | United Kingdom | 70/69 |
| 2146696 | 4/1985 | United Kingdom | 70/69 |

*Primary Examiner*—Gary L. Smith
*Assistant Examiner*—Lloyd A. Gall
*Attorney, Agent, or Firm*—Shapiro and Shapiro

[57] ABSTRACT

Latching system hardware for luggage articles such as attache cases and the like includes an elongated latch console for attachment interiorly to one section of the article, an actuator assembly for manually operating the console latches, and a lock assembly for selectively locking the latches. The hardware can be assembled in different configurations and operating modes and the console can be used with different types of lock and actuator assemblies so that diverse latching systems can be developed from the same basic console components.

38 Claims, 19 Drawing Figures

9
12a
138
38
44
140
26a
212
66a
40a
148
24
150
62a
178
152
186
22
156
88a
52
98
192
158
68a
174
154
160

12a
28a
38
44
204
206
148
150
10
152
24
144
156
158
22
142
180
202
54a
50
40a
170
174
154
212
160
140
146
136
26a
60

LUGGAGE LATCHING SYSTEM

This is a continuation of U.S. Ser. No. 524,691 filed Aug. 19, 1983, which is a continuation of U.S. Ser. No. 240,848 filed Mar. 5, 1981, both of which are now abandoned.

BACKGROUND OF THE INVENTION

The invention relates to luggage articles such as attache cases and the like and to latching systems for such articles.

In recent years, the popularity of attache cases such as leather or vinyl covered wood-frame cases, for example, has been on the increase. Such cases commonly employ a pair of latch assemblies on opposite sides of a central carrying handle and a trend has developed for the use of combination locks in conjunction with such assemblies. Further, with a view toward simplifying the operation of such cases, there have been previous proposals involving the use of a single actuator and locking mechanism for operating the separate latch assemblies.

Due to the increasing popularity of attache cases of the above type, and due to the large number of individual case manufacturers, there is a demand for diversification in the design of the luggage latching and locking system hardware. It is desirable therefore for a hardware manufacturer to produce hardware which is adaptable to diverse customer requirements while at the same time being relatively economical to manufacture and simple to install and operate. The present invention is more particularly directed towards this end.

SUMMARY OF THE INVENTION

It is an object of the invention to provide a form of luggage hardware for attachment to luggage cases and the like in which latching systems of different configuration, appearance or operating mode can be developed from the same basic components.

Another object of the invention is to provide luggage hardware in a form which can be readily assembled into a complete latching system by the hardware manufacturer and which can then be easily installed on an article of luggage by the luggage manufacturer.

A further object of the invention is to provide a novel form of latching console for attachment to a luggage article including spaced hasp-engageable and disengageable latches and operating means therefor, which console can be assembled and used in a variety of different modes in conjunction with manual actuating means and locking means.

The invention may be stated to reside in the concept of providing luggage hardware in modular form. In accordance with this concept, an elongate latch console assembly may be provided which can be attached interiorly to one section of a luggage article, and which may include spaced, hasp-engageable and disengageable latches and operating means therefor, the latches being adapted to cooperate with fixed hasps on a hasp assembly which can be attached interiorly to another section of the article. The console may be designed to function with separate manual actuator and lock assemblies which may be assembled to the console by a hardware manufacturer in different configurations to produce latching systems of different appearance and/or function to meet individual customer preferences. Additionally, the console may be designed to operate with a composite actuator and lock assembly, and the console components themselves may be designed for assembly within the console in different operating modes, for example, to adapt the console selectively to left or right-hand operation.

Hardware in accordance with the invention lends itself to assembly of the console and the lock and actuator assemblies in the required configuration by the hardware manufacturer, and simple installation of the assembled system onto an otherwise completed luggage article.

Specific features of the invention will be apparent from the ensuing description and claims taken in conjunction with the attached drawings.

DESCRIPTION OF PREFERRED EMBODIMENTS

Figure 1:
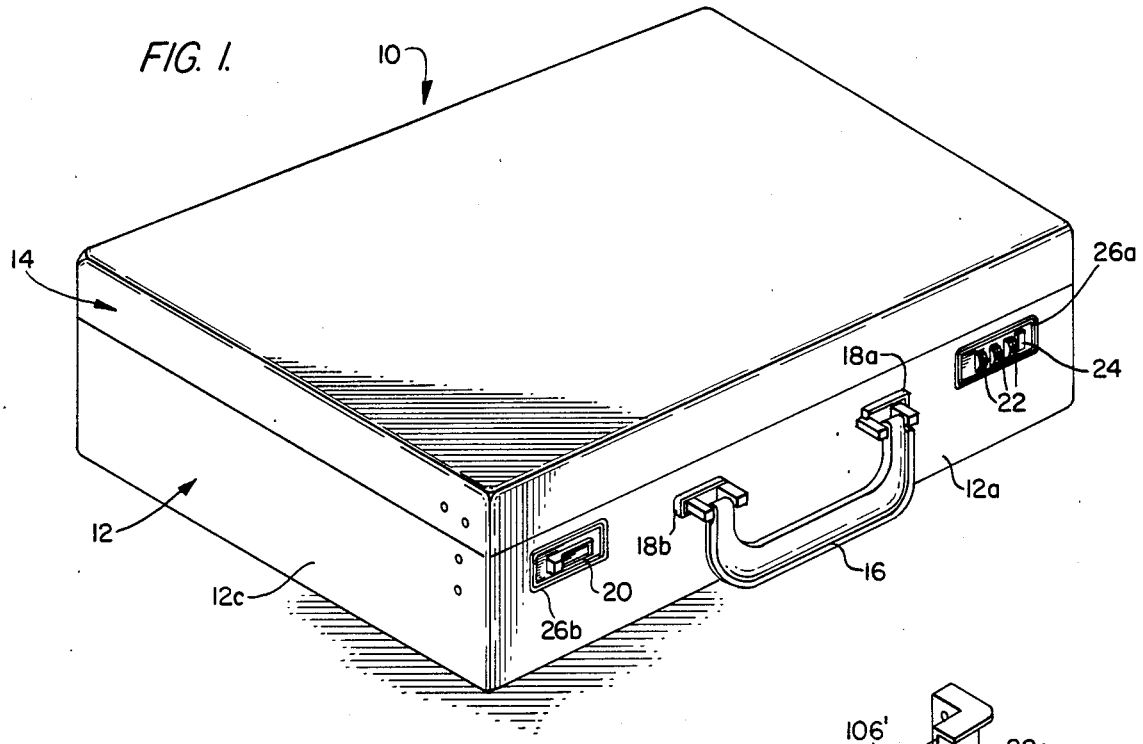
FIG. 1 is a perspective view of an attache case incorporating a latching system in accordance with the invention.

Referring initially to FIG. 1, there is shown an attache case 10, which may be of known vinyl or leather covered wood-frame construction and which includes a body section 12 and a hinged lid 14. The case is fitted with a conventional handle 16 mounted on a front wall 12*a* of the body section, by handle studs 18*a* and 18*b*, and a latching system (shown in more detail in FIGS. 2 and 3) is provided for releasably latching the body section to the hinged lid. In FIG. 1, only exteriorly exposed parts of the latching system are visible, notably a latch actuator 20 on one side of handle 16, dials 22 and a shift member 24 of a combination lock on the other side of handle 16, and escutcheon plates 26*a* and 26*b* surrounding the lock parts and actuator respectively. When dials 22 are set on combination, the case can be opened by drawing actuator 20 to the left to release the latching system, as will be described, and when the dials are off combination, the lock prevents the case from being opened.

Figure 2:
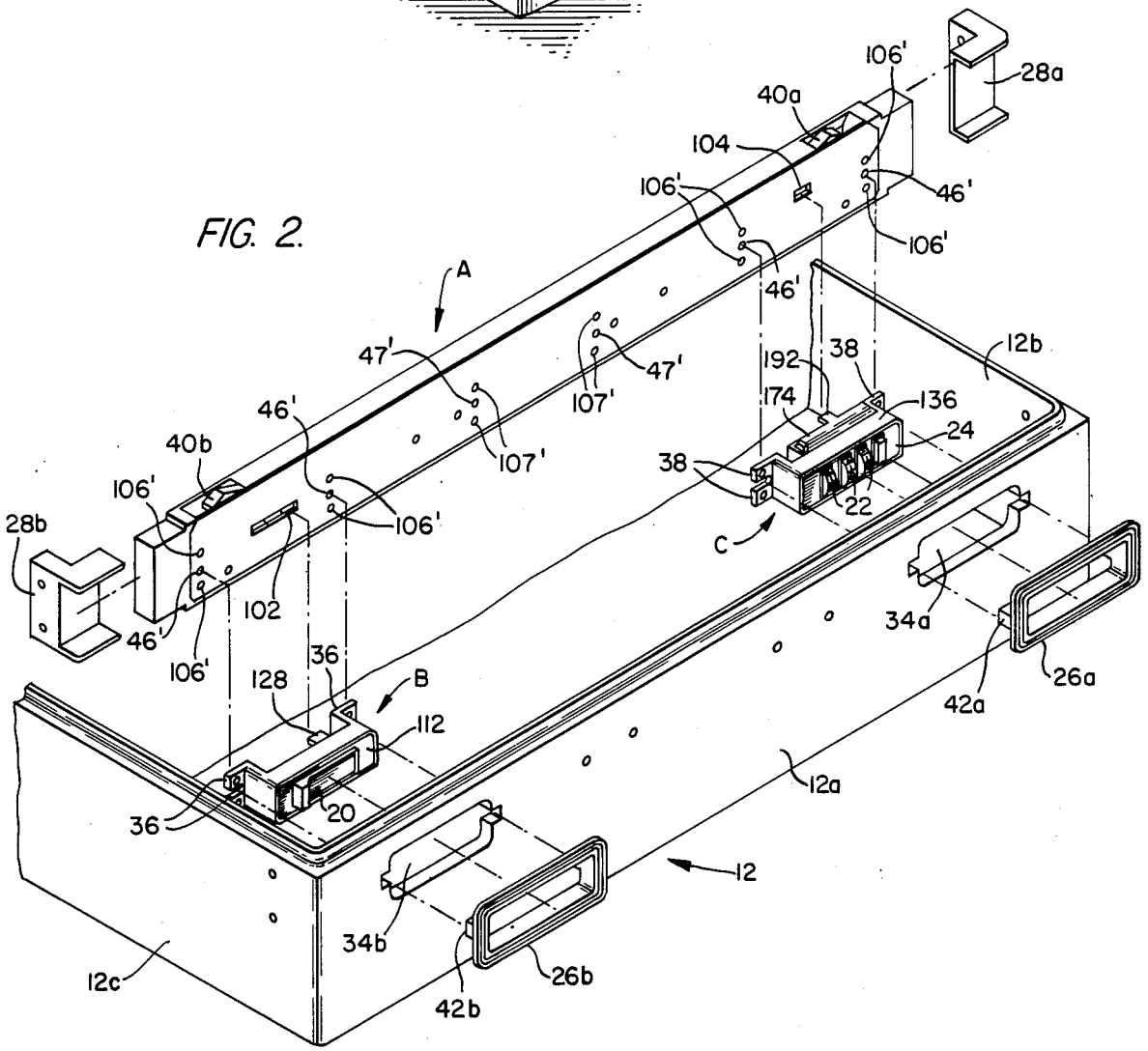
FIG. 2 is an exploded perspective view of certain of the individual assemblies constituting the latching system, such assemblies being shown in their relationship to the body section of the attache case.
Figure 3:
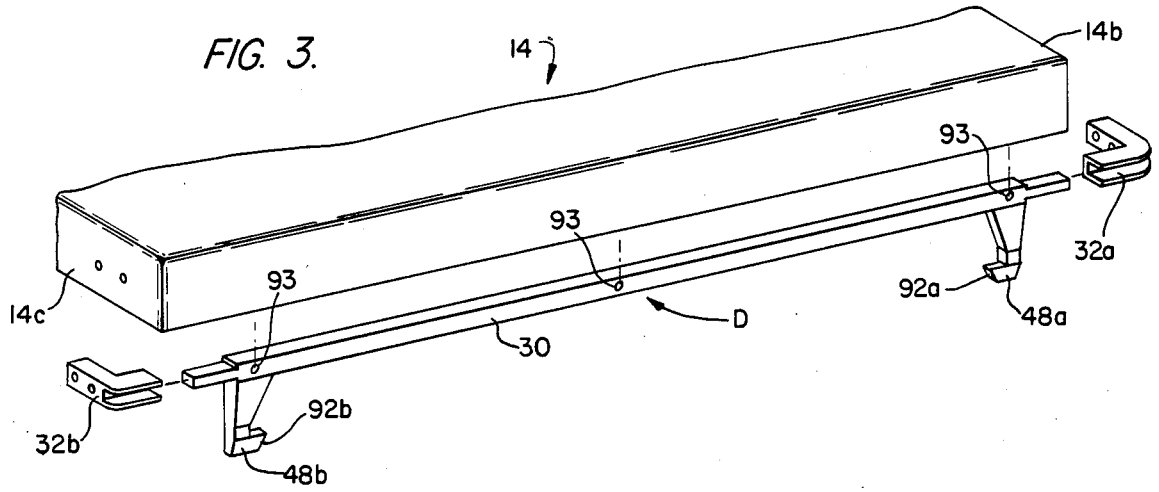
FIG. 3 is an exploded perspective view of a hasp assembly of the system and the lid of the attache case.

As shown in FIG. 2, body section 12 of the case is equipped with an elongate latch console assembly A (attached interiorly to wall 12*a* as will be described), an actuator assembly B, fitting in an opening 34*b* of wall 12*a* and incorporating actuator 20, and a lock assembly C incorporating the combination lock and fitting in a further opening 34*a* in wall 12*a*.

Actuator assembly B and lock assembly C are attached to console A (preferably prior to shipment by the manufacturer) by means of flanges 36, 38 on the respective assemblies, which align with corresponding openings in the console as will be described. Flanges 36, 38 may have openings, as shown, for screwing the flanges to the console, or alternatively the flanges may be formed with rearwardly extending shanks for riveting the flanges to the console.

The latch console A includes longitudinally spaced pivoting latches 40*a* and 40*b*, and drive means for operating the latches in unison. In use, actuator 20 is connected with the drive means for operating the latches and the combination lock cooperates with the drive means to selectively prevent it from being operated by the actuator.

Escutcheon plates 26*a* and 26*b* frame openings 34*a*, 34*b* on the exterior of wall 12*a* and the plates have rearwardly projecting shanks 42*a* and 42*b* extending through wall 12*a* and attached, as by screws 44 (see FIG. 9) to latch console A through further openings in the console as will be described.

Mounting brackets 28*a* and 28*b*, which attach to side walls 12*b* and 12*c* of the case body, by screws or other fastening means, may be provided for supporting latch console A, or the support provided by the escutcheon plate shanks 42*a* and 42*b* and screws 44 may be sufficient to adequately secure the console. As shown in FIG. 2, brackets 28*a* and 28*b* may have channel-like portions for receiving the opposite ends of the latch console while allowing lengthwise adjustment prior to final fixing.

Latches 40*a* and 40*b* cooperate with fixed hasps 48*a*, 48*b* on a rod 30 forming part of a hasp assembly D (FIG. 3) attached interiorly to the case lid 14 by mounting brackets 32*a* and 32*b* which connect to side walls 14*b* and 14*c* of the lid. Brackets 32*a* and 32*b* also have channel-like sections receiving the end portions of rod 30 and providing for lengthwise adjustment so that the hasps and latches can be accurately aligned. Hasp assembly 30 and brackets 32*a*, 32*b* may be plastic moldings.

The construction of latch console A will now be described with particular reference to FIGS. 4 to 6. The console may include an elongate tray-like base plate 50, the aforementioned latches 40*a* and 40*b*, drive means for the latches in the form of an elongate slide rod 52, latch springs 54*a* and 54*b*, hasp ejectors 56*a* and 56*b*, hasp ejector springs 58*a* and 58*b* and a cover plate 60. Conveniently, the base plate, latches and slide rod may be plastic moldings, and the remaining parts may be made of metal.

Right-hand latch 40*a* is in the form of a crank having a mounting section foraed with opposed journals 62*a*, 62*a'* by which the latch is mounted in corresponding holes 64*a*, 64*a'* in the base plate and cover plate, respectively, a hooked hasp-engaging section 66*a* and an actuating section 68*a* formed with a cam surface 70*a*. In the assembled configuration of the console, illustrated in FIGS. 5 and 6, latch 40*a* is mounted for counterclockwise pivoting movement from a hasp-engaging position (FIG. 5) to a hasp-disengaging position (FIG. 6). An opening 72*a* in latch 40*a* houses spring 54*a*, and the spring operates against a base plate post 74*a* projecting into opening 72*a* to provide biasing means urging the latch towards the hasp-engaging position. An opening 76*a* in side wall 78 of the base plate provides access to latch 40*a* for hasp 48*a*.

Similarly, the left-hand latch 40*b* is also in the form of a crank having a mounting section formed with opposed journals 62*b*, 62*b'* by which the latch is mounted in corresponding holes 64*b*, 64*b'* in the base plate and cover plate, respectively, a hooked hasp-engaging section 66*b* and an actuating section 68*b* formed with a cam surface 70*b*. In the assembled configuration of the console, illustrated in FIGS. 5 and 6, latch 40*b* is mounted for clockwise pivoting movement from a hasp-engaging position (FIG. 5) to a hasp-disengaging position (FIG. 6). An opening 72*b* in latch 40*b* houses spring 54*b*, and the spring operates against a base plate post 74*b* projecting into opening 72*b* to provide biasing means urging the latch towards the hasp-engaging position. An opening 76*b* in side wall 78 of the base plate provides access to latch 40*b* for hasp 48*b*.

Hasp ejector 56*a* fits between base plate projections 80*a* and 82*a*, the latter serving as a guide, and spring 58*a* urges the ejector towards opening 76*a*. When hasp 48*a* is engaged (FIG. 5), spring 58*a* is compressed and when latch 40*a* releases the hasp, the ejector urges the hasp upwardly by extension of spring 58*a* to facilitate opening of the attache case by lifting the lid. Ejector 56*b* is similarly arranged at the left end of the base plate between projections 80*b* and 82*b*, to act on hasp 48*b*.

Slide rod 52 is guided for lengthwise movement in an elongate base plate channel 84 defined between wall 78 and a land surface 86, and the rod is formed at its opposite ends with latch-actuating lobes 88*a*, 88*b*. Lobe 88*a* has a cam surface 90*a* providing cooperative camming means with cam surface 70*a* of latch 40*a* and lobe 88*b* has a cam surface 90*b* providing cooperative camming means with cam surface 70*b* of latch 40*b*.

When the latches are engaged with the respective hasps, the slide rod is in a right-hand position with respect to the base plate (FIG. 5), and when the rod is moved lengthwise to the left in channel 84 (by means of actuator 20, as will be described), the cooperative camming surfaces effect simultaneous pivoting movement of the latches, in opposite senses respectively, from their hasp-engaging positions to their hasp-disengaging positions (FIG. 6) accompanied by compression of latch springs 54*a*, 54*b*. Then, when the hasps are ejected and the actuator has been released, springs 54*a*, 54*b* return the respective latches to their hasp-engaging positions and through the cooperative camming surfaces, also return the slide rod to its initial position.

Lobe 88*b* of slide rod 52 is provided with an opening 96 for receiving a drive member of the actuator assembly and lobe 88*a* has an opening 98 for receiving a locking member of the lock assembly. Further, the slide rod may have centrally disposed mounting recesses 100 to receive a mounting bracket or the like for providing similar drive and locking means for the rod if the console is to be used with a centrally located composite lock and actuator assembly in place of the separate assemblies B and C (see FIG. 18).

It may here be noted that when the latches are in their hasp-engaging positions (FIG. 5) they are free to pivot toward their hasp-disengaging positions independently of movement of the slide rod. Thus, when the hasps are disengaged, they can be re-engaged by effecting a camming action between hasp surfaces 92*a* and 92*b* and complementary latch surfaces 94*a* and 94*b*. Accordingly, the latch system incorporates a scramble feature enabling the hasps to be engaged even when the slide rod is locked in position by the combination lock.

Cover plate 60 (FIG. 4) includes an elongate slot 102 aligned with opening 96 in the slide rod and through which the actuator drive member projects into opening 96, the slot being of sufficient length to provide the required travel of the slide rod to release the latches. A smaller opening 104 at the opposite end of the cover plate provides access for the locking member into the slide rod opening 98. The cover plate and base plate have aligned openings 106, 106' used for assembling the cover plate to the base plate by means of the screws or rivet shanks carried by the flanges 36, 38 on actuator assembly B and lock assembly C. Openings 46 in the base plate and 46' in the cover plate receive the screws, such as screws 44 (FIG. 9), which connect to the escutcheon plates 26*a*, 26*b* and fasten the console and attached lock and actuator assemblies to the attache case. The cover plate and base plate may also include further aligned openings 110, if it is required to fasten the attache case handle 16 through the latch console, and centrally disposed openings 107, 107' and 47, 47' for mounting a composite lock and actuator assembly and single escutcheon plate.

Figure 4:
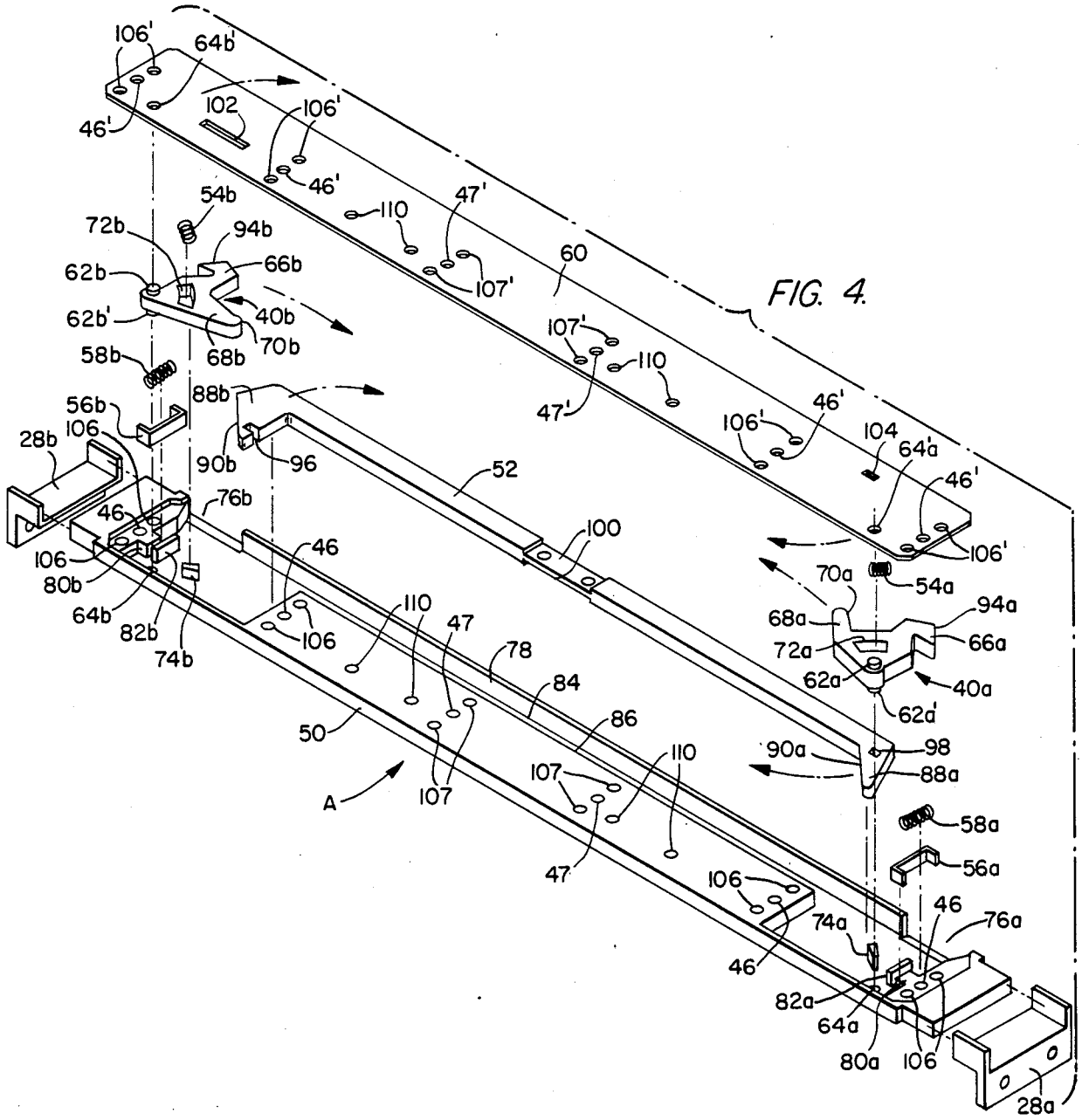
FIG. 4 is an exploded perspective view of the latch console assembly of the latching system.
Figure 5:
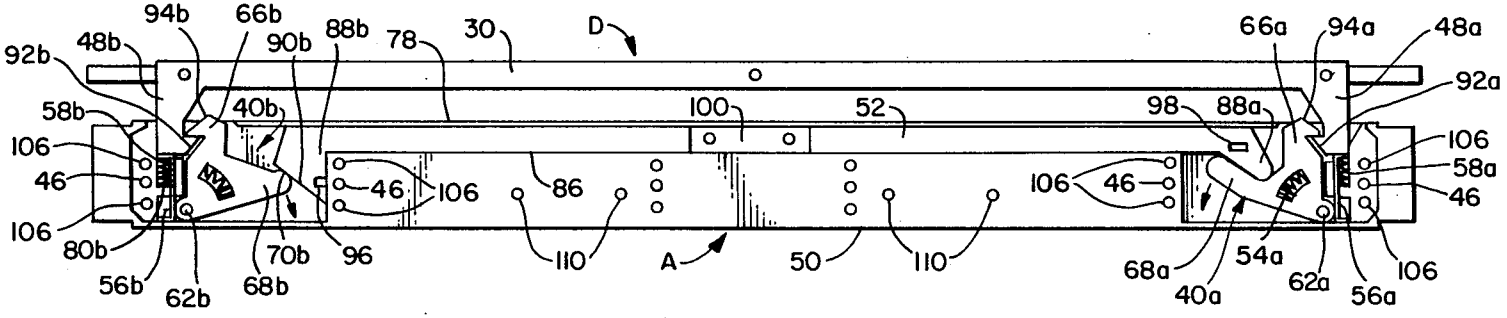
FIG. 5 is an elevational view of the latch console assembly with the cover plate removed and with the console latches shown in engagement with their respective hasps.
Figure 6:
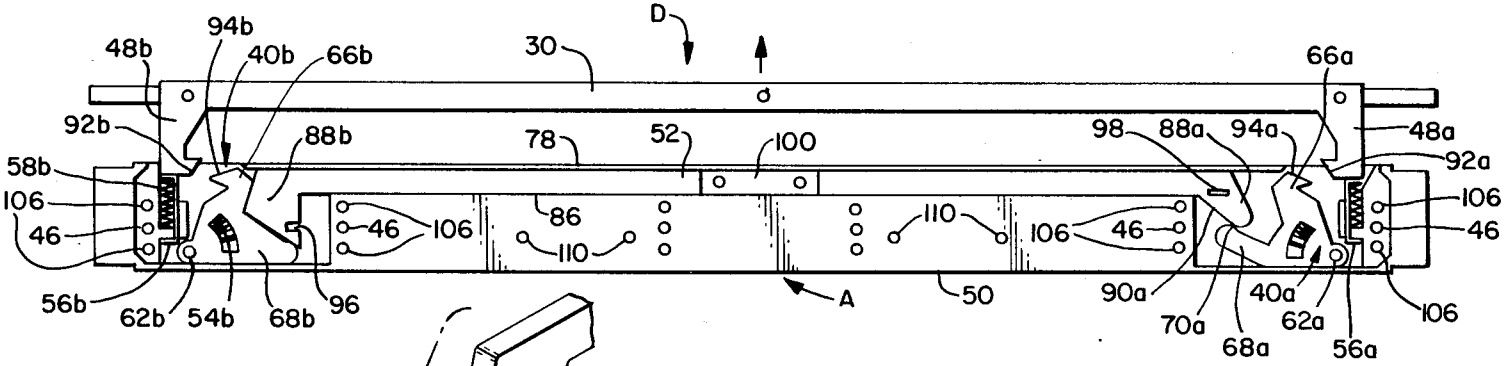
FIG. 6 is a view similar to FIG. 5 showing the latches released from the hasps.

As shown in FIGS. 4 to 6, the components of the latch console are assembled for right-to-left movement of the slide rod to effect opening of the latches and for receipt of the actuator assembly B at the left end and lock assembly C at the right end of the console, respectively. In accordance with the invention, however, the console components can also be assembled in a reverse mode, for left-to-right movement of the slide rod to effect latch opening, with the actuator assembly at the right end of the console and the lock assembly at the left end. As indicated by the dashed-line arrows in FIG. 4, such reverse assembly may be effected by inverting and transposing the latches and by lengthwise inversion of the slide rod and cover plate relative to the base plate. The console is shown assembled in the reverse mode in FIG. 16 with the cover plate removed.

Figure 7:
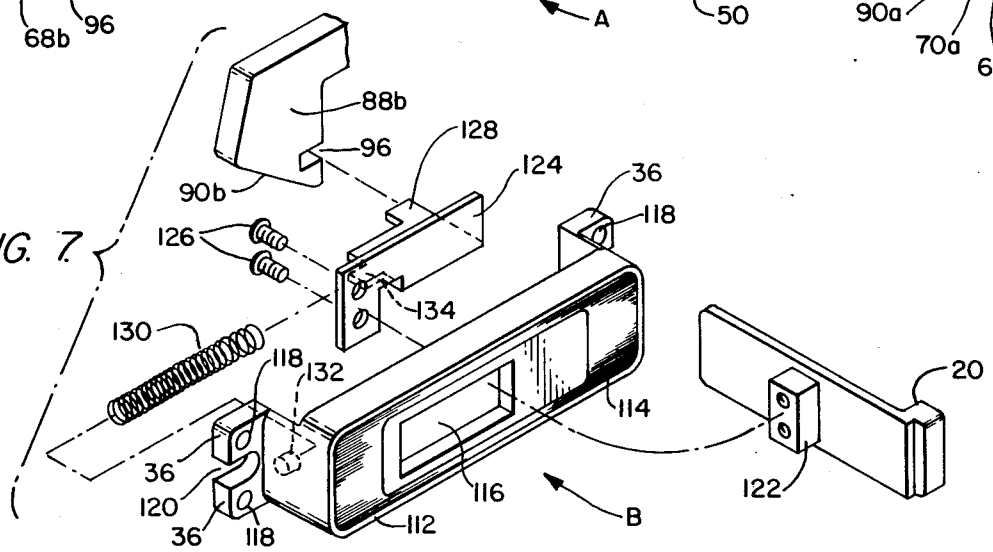
FIG. 7 is an exploded perspective view of an actuator assembly of the latching system.

Actuator assembly B is shown in detail in FIG. 7 in conjunction with lobe 88*b* of slide rod 52. The assembly includes a body member 112 integrally formed with the flanges 36 and having a face plate portion 114 formed with a central opening 116. As previously indicated, the flanges may be formed with screw holes 118 for attaching the assembly to the latch console, or alternatively, the flanges may have rearwardly extending rivet shanks or the like. Further, the flanges may have central openings 120 to receive shanks 42*b* of escutcheon plate 26*b* (FIG. 1).

The manual actuator 20 sits on face plate portion 114 and has an integral block 122 on its back face projecting through opening 116. An actuator bracket 124 is attached to block 122, for example by screws 126, the bracket including a projecting tab 128 adapted to fit through slot 102 in cover plate 60 of the latch console into opening 96 in slide rod 52. Tab 128 thus forms a drive member for moving the slide rod responsive to manual movement of actuator 20. A spring 130 mounted between a plug 132 integral with body member 112 and a further tab 134 on bracket 124 urges the actuator to the right as illustrated.

With the above arrangement, when actuator assembly B is attached to latch console A, manual movement of actuator 20 to the left against spring 130 draws slide rod 52 to the left thus releasing the latches 40*a* and 40*b*. When the actuator is released, latch springs 54*a* and 54*b* return the latches and slide rod to their initial positions and spring 130 returns the actuator to its rest position.

Figure 16:
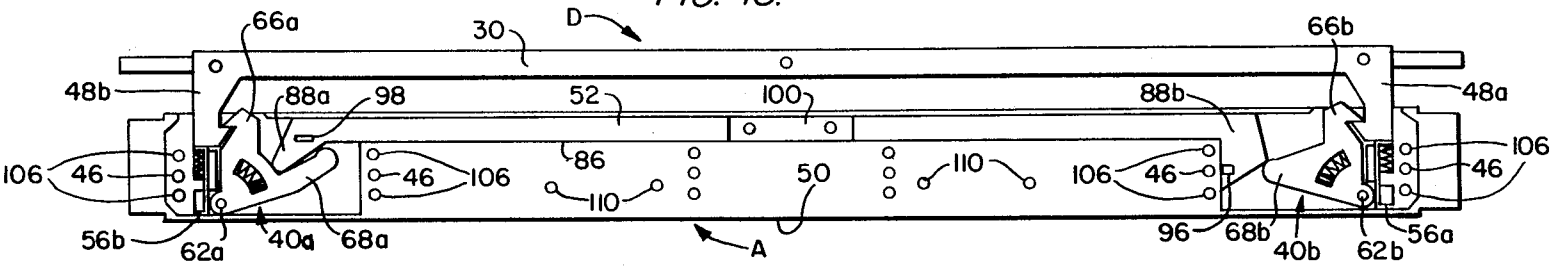
FIG. 16 is an elevational view of a latch console assembly similar to FIG. 5 but showing components of the console arranged in an alternative, reverse configuration.
Figure 17:
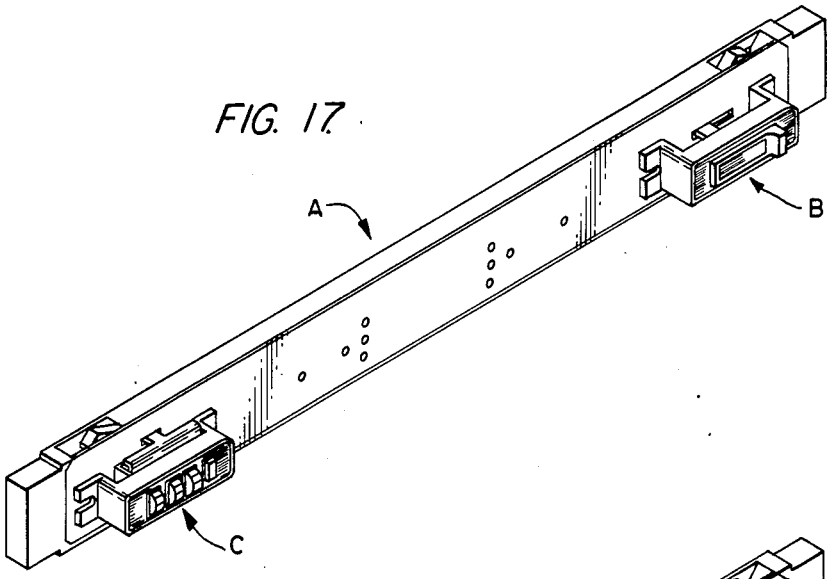
FIG. 17 is a perspective view of the latch console assembly as shown in FIG. 16 with the lock assembly and actuator assembly attached.

The relative locations of tab 128, slot 102 in the console cover plate, and opening 96 in slide rod 52 may be such that when the latch console is assembled in the reverse mode as shown in FIG. 16 and the actuator assembly is swung around and mounted at the right end of the console, for left-to-right movement of actuator 20 (see FIG. 17), tab 128 will still accurately align with slot 102 and opening 96.

Lock assembly C is shown in detail more particularly in FIGS. 8–14. A main body member 136 of the lock assembly is integrally formed with the mounting flanges 38 in like manner to the body member 112 of the actuator assembly. Flanges 38 also have screw openings 138 (or alternatively may again have rivet shanks) for attachment of the lock assembly to the latch console and the screw openings or shanks are preferably on the same centers as those of the actuator assembly. Openings 140 between flanges 38 provide passage for the escutcheon plate fastening screws 44.

The outer surface 140 of member 136 forms the face plate of the combination lock and is provided with openings 142 for the respective combination dials 22 and a further opening 144 for shift member 24. A dished cover plate 146 is secured internally to body member 136 (by suitable fasteners 148) to define with the body member a lock casing. A shaft 150 is mounted within the casing on suitable support surfaces of the body member and cover plate, the shaft having an integral or fixed collar 152 adjacent one end. Carried on the shaft, between collar 152 and a coil compression spring 154 are axially abutting combination sleeves 156, the left ends of which are formed as cams 158. On the opposite side of collar 152, shaft 150 carries the shift member 24. Spring 154 acts between a washer 160 and the endmost sleeve to urge the assembly of shaft, sleeves, and shift member to the right.

Figure 14:
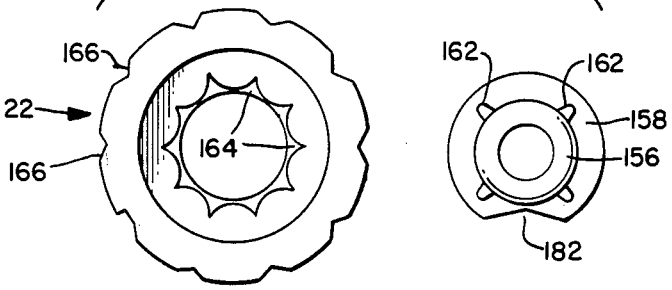
FIG. 14 is a composite end view of a combination dial and a combination sleeve.

The sleeves are each encircled in known manner by one of the dials 22, the sleeves being coupled for rotation with the dials by means of sleeve teeth 162 engaging openings 164 in the respective dials (see FIG. 14).

The dials each have a peripheral series of combination indicia with detents 166 therebetween and a dial spring 170 on the base of cover plate 146 has pairs of arms 172 (see FIG. 10) for engaging the detents, so that the dials may be manually rotated in equal increments between the respective indicia settings.

A bolt 174 (see FIG. 13) is pivotally mounted within the lock casing by means of projecting ears 178 carried in suitable openings (not shown) in opposite end walls of cover plate 146. The bolt has cross-bars 180 formed with V-shaped ridges adapted to engage in corresponding V-shaped notches 182 in the cams 158 (see FIGS. 10 and 14). Slots 184 between the bolt cross-bars accommodate the dials.

Figure 8:
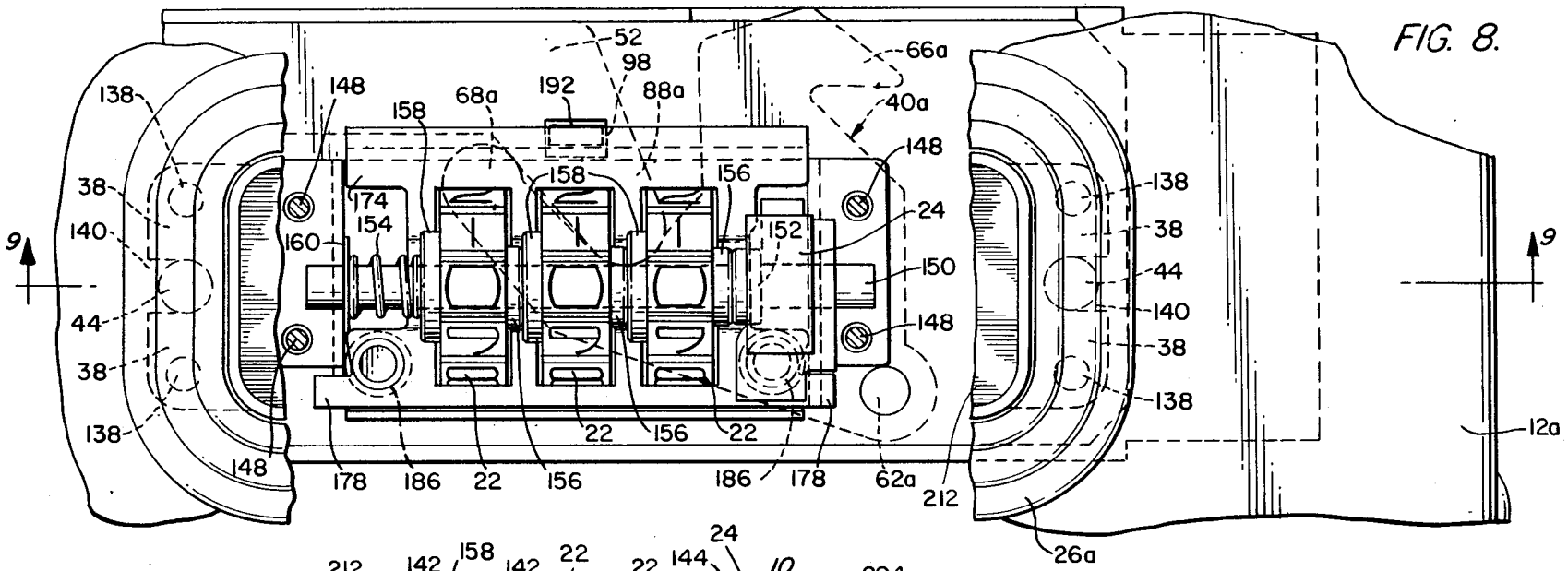
FIG. 8 is an elevational view, partly broken away, of a lock assembly of the latching system shown in assembled relation with the latch console and body section of the attache case.
Figure 9:
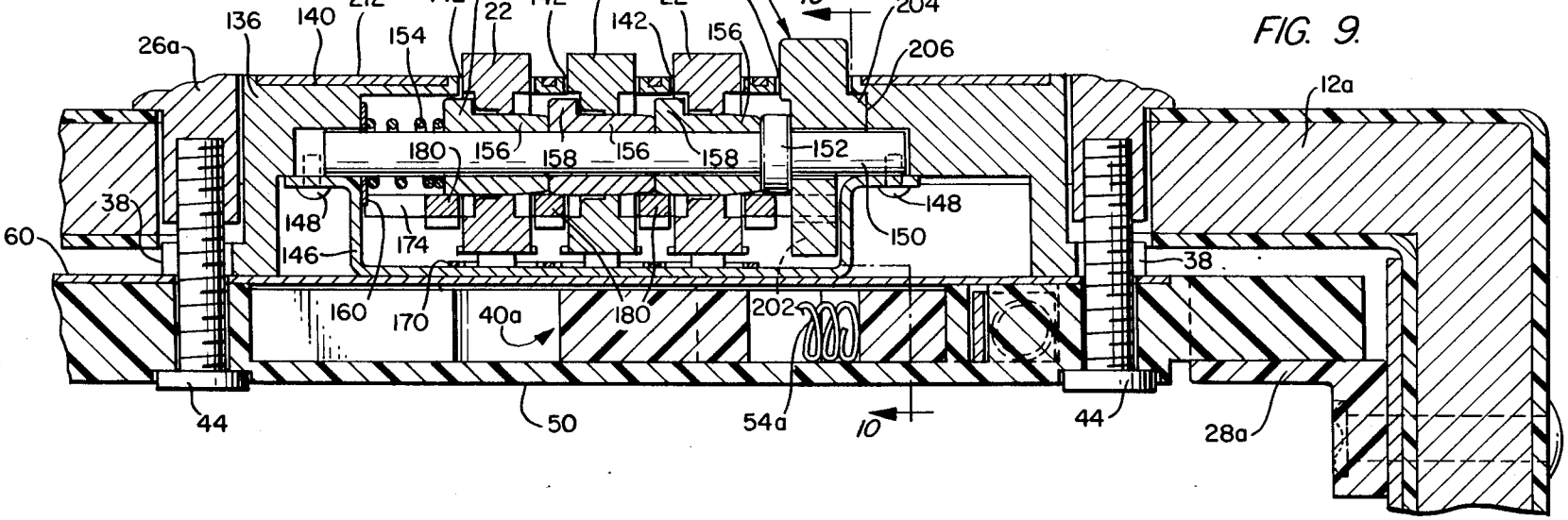
FIG. 9 is a sectional view on line 9—9 of FIG. 8.

The bolt is urged upwardly by means of bolt springs 186 on the base of cover plate 146, the springs being located in bolt bosses 188, so that the ridge portions of the cross-bars contact the peripheries of the cams 158. When all the cams are aligned so that the bolt ridges are all received in the respective cam notches (the on combination setting of the lock) the bolt is raised under the influence of springs 186, as shown in FIGS. 8 and 9 and in full line in FIG. 10. When, however, any one or more of the cams is rotated by one or more dial-indicium settings away from the on-combination setting, the relevant ridge portion of the bolt is moved out of its respective notch by a camming action, so that the bolt is lowered to the position shown in phantom in FIG. 10, the ridge portion then engaging the circular periphery of the respective cam. (A more detailed description of a lock of this nature is contained in copending U.S. patent application Ser. No. 033,540 to Remington, filed April 26, 1979 and commonly assigned herewith. The entire disclosure of the copending application is incorporated herein by reference.)

The free edge of the bolt opposite pivots 178 is bent down and proJects through an opening 190 on one side of the lock casing. A depending tab 192, forming a locking member for the latch console slide rod, is provided on the free edge. When the lock assembly is suitably attached on the console cover plate, and the bolt is in its locked, lowered position (the lock being off combination), tab 192 engages in opening 98 in the console slide rod through opening 104 in the cover plate and prevents the slide rod from being operated by the manual actuator, so that the attache case can be locked closed. When the lock dials are moved to the on-combination setting, the bolt is allowed to rise, as described above, to lift tab 192 from within opening 98 and allow the manual actuator to operate the console slide rod and latches. The dials thus form control means for tab 192.

In the illustrated embodiment, tab 192 is asymmetrically located as between the left and right-hand flanges 38 of body member 136. Accordingly, if the lock assembly and actuator assembly are to be transposed into the positions illustrated in FIG. 17 (the latch console being assembled in the FIG. 16 mode), a substitute bolt 174 with a repositioned tab 192 may be provided in order properly to position the tab in relation to openings 98 and 104.

Shift member 24 may be used to change the set combination of the lock by uncoupling the sleeves from the dials when the lock is on-combination, allowing one or more of the dials to be rotated relative to the associated sleeve or sleeves. As seen more particularly in FIG. 12, the shift member has a body section 194 defining a transverse slot 196 through which shaft 150 passes when the lock is assembled, and a cam surface 198, an actuator portion 200 and a blocking portion 202. A rear section 204 of the body portion 194 fits in a recess 206 in body member 136 of the lock (see FIGS. 9 and 11) to locate and guide the shift member for translatory movemcnt transversely of the shaft.

Figure 10:
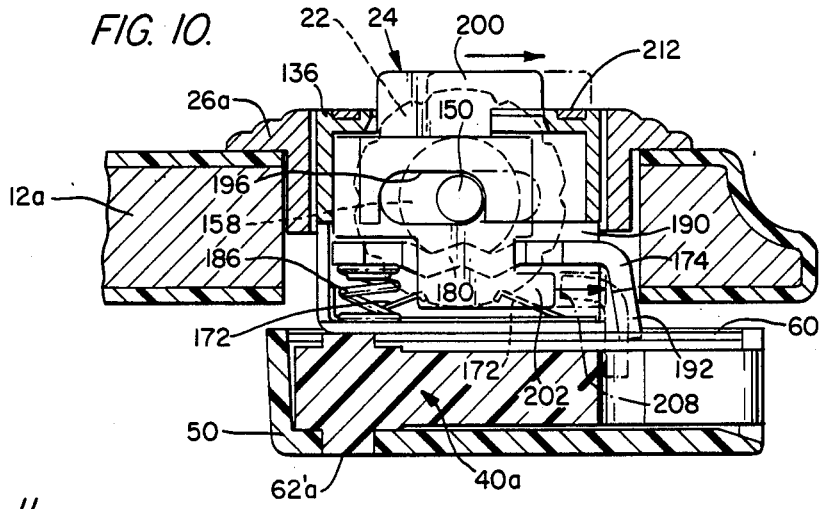
FIG. 10 is a sectional view on line 10—10 of FIG. 9.
Figure 11:
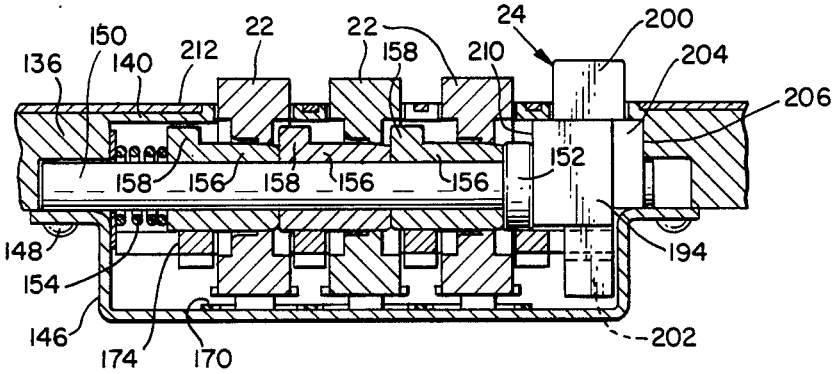
FIG. 11 is a sectional view of the lock assembly similar to FIG. 9 but shown in a combination-changing position.
Figure 12:
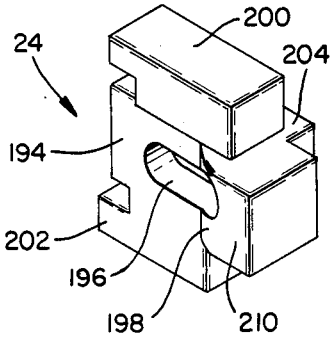
FIG. 12 is a perspective view of a shift member used in the lock assembly.
Figure 13:
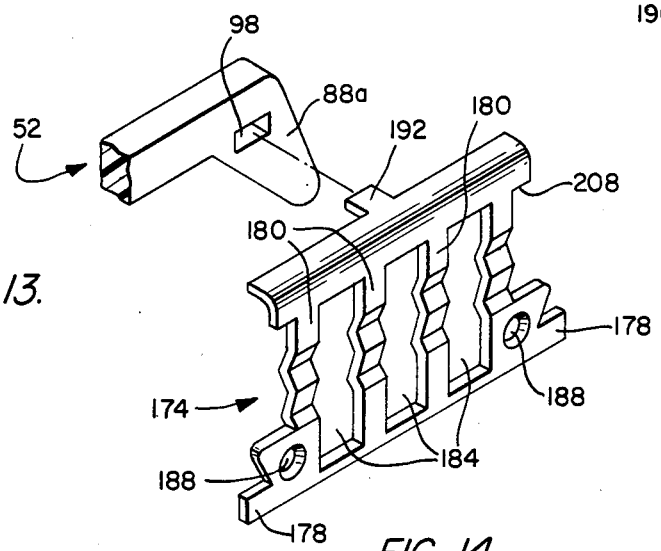
FIG. 13 is a perspective view of a pivotal bolt of the lock assembly shown with part of a slide rod of the latch console; .

When the lock bolt is lowered, the lock being off combination, an edge surface 208 of the bolt (see FIGS. 10 and 13) is in blocking relationship to blocking section 202 of the shift member, to prevent the member being moved transversely. When the lock is on combination, however, and the bolt is raised, surface 208 clears blocking section 202 and the shift member can be moved transversely to the right as shown in FIG. 10. This movement effects a camming action between surface 198 of the shift member and shaft collar 152, shifting the shaft and sleeves to the left as seen in FIG. 10, so that the sleeves are uncoupled from the dials. The shifted position of the lock is shown in FIG. 11. In this position, shaft collar 152 engages a flat surface 210 of the shift member to prevent spring 154 from forcing the sleeves and shaft back into the FIG. 9 position. Accordingly, the shift member can be released and the lock's combination can be adjusted. It will also be noted that in the shifted position, blocking section 202 of the shift member sits under the bolt thereby preventing the bolt from being lowered and avoiding a possible loss of the set combination.

After the combination has been adjusted, the shift member can be returned to its initial position, thereby allowing spring 154 to force the sleeves back into coupling engagement with the dials and setting the new combination.

As previously indicated, the screw openings or shanks on flanges 36 and 38 of the actuator and lock assemblies are preferably on the same centers, to facilitate the transposition of these assemblies. Further, the body members of the respective assemblies may have the same outer profile, to provide a balanced appearance to the attache case and to facilitate the mounting of the assembled hardware on the case by allowing openings 34*a* and 34*b* in wall 12*a* of the case (see FIGS. 2 and 16) to be identical irrespective of the mode in which the hardware is assembled and providing uniformity in the dimensions of escutcheon plates 26*a* and 26*b*.

Figure 15:
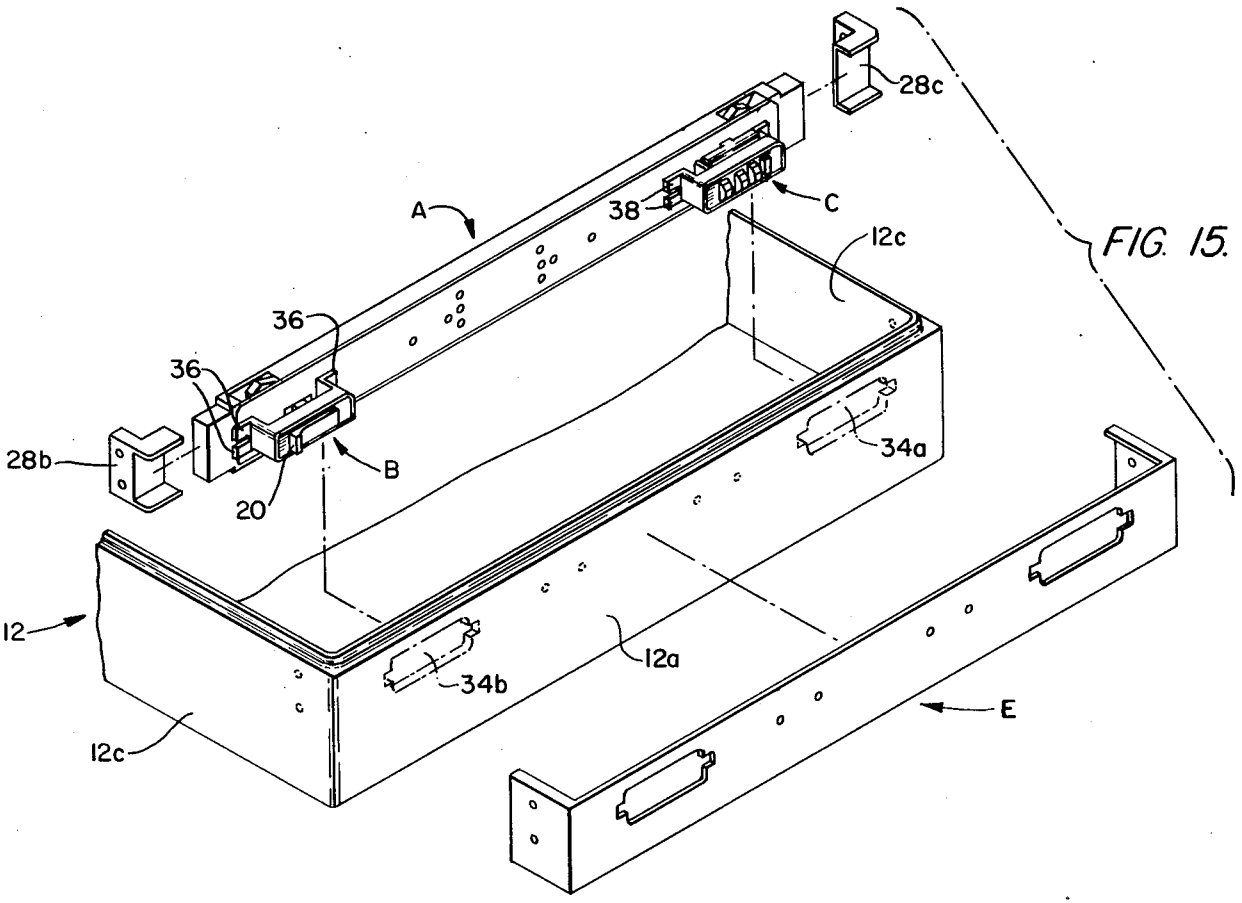
FIG. 15 is a perspective view of parts of the latching system and attache case illustrating the manner of preparing the case for installation of the system.

FIG. 15 illustrates a convenient way in which the hardware may be simply installed on the attache case. Such assembly may, for example, be done after the case is otherwise fully assembled and covered. It is preferred for console A to be supplied to a luggage manufacturer with the actuator and lock assemblies B and C already in place. A suitable template or jig arrangement E, diagrammatically illustrated in FIG. 15, may also be supplied for facilitating the formation of openings 34*a* and 34*b* in wall 12*a* of the case and also for locating the positions for forming openings to accept screws or the like for brackets 28*a* and 28*b*. (A similar jig or template may be supplied for forming openings in the case lid for attachment of hasp assembly D, or alternatively, a composite jig arrangement may be provided for forming the openings in both the case body member and lid.)

After suitably piercing the required openings in the case body member, it is merely necessary to insert the lock and actuator assemblies through openings 34*a*, 34*b* from the interior of the case and secure the hardware by insertion of the escutcheon plates from the exterior. Where separate lock and actuator assemblies are provided, as illustrated, it may be possible to dispense with brackets 28*a* and 28*b*, with the escutcheon plate attachments providing the sole support for the hardware. To provide flush fitting of the latch console against the interior of wall 12*a*, recesses may be formed in the wall to accommodate flanges 36, 38 of the actuator and lock assemblies or alternatively, an insert sheet may be used.

After attachment of the latch console, the hasp assembly may be attached to the case lid by means of brackets 32*a*, 32*b*. Horizontal alignment of the latches and hasps may be checked by closing and opening the case, and the hasp assembly may then be fixed longitudinally by driving twist nails, screws or the like, through the case lid into holes 93 in rod 30 (see FIG. 3). The provision of a single rod 30 incorporating both hasps provides accurate spacing and alignment of the hasps to relieve the luggage manufacturer of a hasp-aligning operation.

To further increase the versatility of the system in providing luggage hardware which can be produced from the same components in a variety of different appearances, the outer surfaces of, for example, actuator 20 and body members 112 and 136 may be covered with metallic covering sheets (as for example, sheet 212, see FIGS. 8 and 9) selected from a range of such sheets having different surface finishes. Covering sheets of this nature and the manner in which they may be secured are disclosed in copending U.S. patent application to O. Vincent Scarnecchia, Ser. No. 219,956, filed Dec. 24, 1980, titled "Improvements Relating to Combination Locks", and commonly assigned herewith. The entire disclosure of the copending application is incorporated herein by reference.

Figure 18:
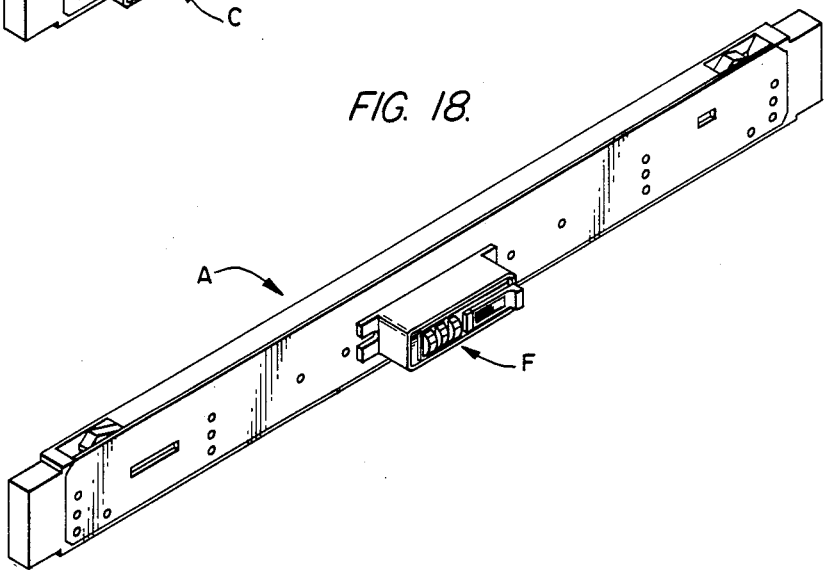
FIG. 18 is a perspective view of the latch console assembly with a centrally attached composite lock and actuator assembly.

FIG. 18 shows an arrangement wherein the latch console A, as previously described, is provided with a composite, centrally located, lock and actuator assembly F in place of the separate assemblies of the previous embodiment. In this arrangement, slide 52 is provided with a central bracket, attached to one of the recesses 100 (see FIG. 4) to cooperate with assembly F and suitable openings (not shown) are formed in cover plate 60 to provide access to the bracket. Lock and actuator assembly F may be of a type in which an actuator drive member engages an opening in the slide rod bracket and the lock has a locking member adapted to enter a further opening in the bracket to lock the slide rod in similar manner to the individual assemblies previously described. Alternatively, assemby F may be of the type in which a locking member acts directly on the actuator rather than on the latch console slide member. A lock of this type is shown, for example, in U.S. Pat. No. 3,800,571 to Heine, issued Apr. 2, 1974, and commonly assigned herewith. In this case, only a single opening need be provided in the slide rod.

Figure 19:
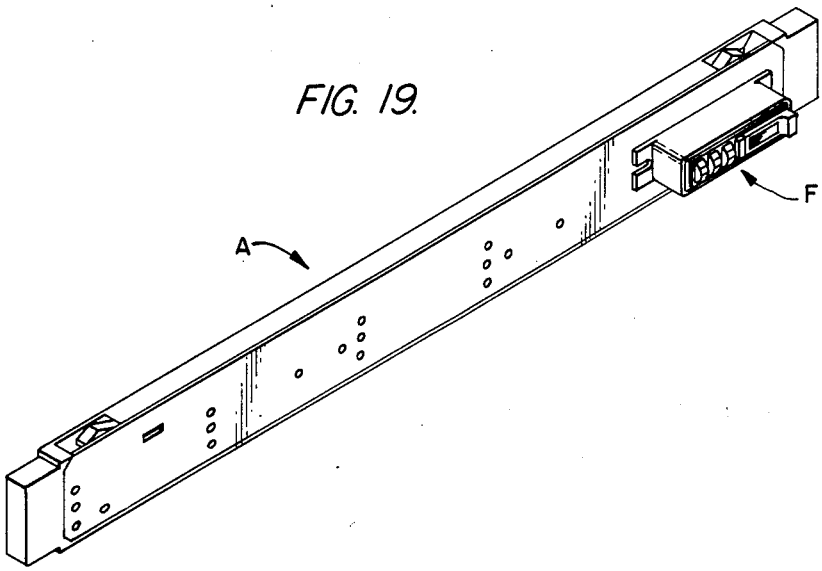
FIG. 19 is a view similar to FIG. 18 but showing the composite lock and actuator assembly attached to the console in an offset position.

FIG. 19 shows an arrangement in which the combined lock and actuator assembly F is mounted at the right end of console A, and it will be appreciated that with this arrangement a suitably located opening is again provided in the slide rod for the actuator drive member and a further opening for the locking member, if appropriate. The system shown in FIGS. 18 and 19 may be installed on a luggage case in a similar manner to the previously described embodiments and using the latch console end brackets 28*a* and 28*b* for stability, since only a single escutcheon plate will be used.

It will be seen from the foregoing description that the invention provides a latching hardware system for luggage articles which is extremely versatile and can be assembled to provide a variety of configurations, appearances or operating modes, all using the same basic latch console components. The latch console can be used with cases of different width and wall thickness and can be easily mounted using unsophisticated tools. The inventive system provides excellent alignment characteristics of the latches and hasps, with no rivets being visible from the top of the case, and provides automatic closure and smooth operation. Production costs may be made competitive with the cost of two conventional combination locks.

While only preferred embodiments of the invention have been described herein in detail, the invention is not limited thereby and modifications can be made within the scope of the attached claims.

I claim:

1. A luggage article latching system including an elongate latch console comprising spaced hasp-engageable and disengageable latches, drive means for operating said latches in unison and means permitting an actuator assembly for operating said drive means to be mounted on said console selectively in alternative locations.

2. A latching system as defined in claim 1, wherein said drive means includes a slide rod mounted for longitudinal movement lengthwise of the console, the slide rod including means for forming a drive connection with an actuator assembly selectively at alternative locations lengthwise of the slide rod.

3. A latching system as defined in claim 2, wherein said console includes a base plate and a cover plate, said latches and drive means being assembled between said plates and wherein said cover plate includes means for attaching an actuator assembly at selective locations lengthwise of the cover plate.

4. In a luggage article, a latching system comprising an elongate latch console having parts combined for attachment as a unit interiorly to one wall of a section of the article, said console parts including a base plate, a pair of longitudinally spaced latches supported on said base plate and adapted to releasably engage corresponding hasps on another section of the article to latch the sections together, drive means supported on said base plate for moving the latches from hasp-engaging to hasp-disengaging positions, and an actuator assembly positioned for receipt in an opening in said wall of the article from the interior thereof, said actuator assembly including a manual actuator adapted to be exposed exteriorly of said wall of the article for operating said latches through said drive means, the system further comprising an escutcheon plate for mounting on the exterior of said wall of the article to frame said opening, the escutcheon plate including means adapted to extend rearwardly through said wall adjacent the actuator assembly for fastening said escutcheon plate to said console to thereby attach the console to the luggage article, said one section of said luggage article having a pair of rigid opposite walls fixed perpendicular to said one wall, said system also comprising mounting brackets which fit on opposite ends of said console and means for fastening said brackets to said opposite walls.

5. A system as defined in claim 4, including a lock assembly carried by said console, said lock assembly including a locking member for selectively preventing operation of the latches by means of the actuator, and control means for the locking member.

6. A luggage article latching system including an elongate latch console for attachment interiorly to one wall of a section of the article, said console having a pair of longitudinally spaced latches adapted to releasably engage corresponding hasps on another section of the article to latch the sections together, and drive means for moving the latches from hasp-engaging to hasp-disengaging positions, an actuator assembly carried by the console for receipt in an opening in said wall of the article, said actuator assembly including a manual actuator adapted to be exposed exteriorly of said wall of the article for operating said latches through said drive means, the system further including an escutcheon plate for mounting on the exterior of said wall of the article to frame said opening, means adapted to extend rearwardly from said escutcheon plate through said wall adjacent the actuator assembly for fastening said escutcheon plate to said console, and a lock assembly carried by said console, said lock assembly including a locking member for selectively preventing operation of the latches by means of the actuator, and control means for the locking member, wherein said lock assembly is separated from said actuator assembly for receipt in a further opening in said wall of the article, with said control means exposed exteriorly of said wall, and the system further includes another escutcheon plate for mounting on the exterior of said wall to frame said further opening, and means adapted to extend through said wall from said another escutcheon plate for fastening said another escutcheon plate to said console.

7. A system as defined in claim 6, wherein said lock assembly comprises a combination lock.

8. A latch console for use on a luggage article comprising an elongate base plate, a pair of pivotal hasp-engageable and disengageable latches mounted in longitudinally spaced relation on said base plate for pivoting movement in opposite senses with respect to each other from hasp-engaging to hasp-disengaging positions, a slide rod carried by said base plate for pivotally moving the latches in unison from their hasp-engaging to their hasp-disengaging positions responsive to lengthwise movement of the slide rod in one direction, means permitting the latches to be transposable and the slide rod to be reversibly mountable lengthwise on the base plate for operating the latches by lengthwise movement of the slide rod in the opposite direction.

9. A latch console as defined in claim 8, including first cooperative cam means between the slide rod and one of said latches, second cooperative cam means between the slide rod and the other of said latches, the first and second cam means being effective to simultaneously pivot each latch in said opposite senses with respect to each other to move the latches from their hasp-engaging to their hasp-disengaging positions responsive to lengthwise movement of the slide rod in said one direction, each latch being mountable on the base plate in an inverted condition when transposed with the other latch to provide cooperation of the first and second cam means when the slide rod is mounted on the base plate in the reversed position.

10. A latch console as defined in claim 8, including biasing means for returning the latches to their hasp-engaging positions subsequent to operation of the slide rod.

11. A latch console as defined in claim 8, wherein the latches are mounted for movement independently of the slide rod from their hasp-engaging to their hasp-disengaging positions.

12. A latch console as defined in claim 8 including means associated with said slide rod for forming a drive connection with a manual actuator, whereby lengthwise movement of the slide rod is effected by codirectional movement of the actuator, said means associated with the slide rod being adapted to form a drive connection with the actuator when the slide rod is mounted in the reversed position.

13. A latch console as defined in claim 12, wherein said slide rod includes an opening for receiving a locking member adapted to preclude lengthwise movement of the slide rod, said opening being further adapted to receive a locking member when the slide rod is mounted in the reversed position.

14. A latch console for use on a luggage article including an elongate base plate, a pair of longitudinally spaced hasp-engageable and disengageable latches mounted on said base plate for simultaneous pivoting movement in opposite senses with respect to each other from hasp-engaging to hasp-disengaging positions, a slide rod extending longitudinally of said base plate, first cooperative cam means between said slide rod and one of said latches for translating lengthwise movement of said slide rod in one direction into pivoting movement of said one latch in one sense from its hasp-engaging position to its hasp-disengaging position and second cooperative cam means between said slide rod and the other of said latches for translating lengthwise movement of the slide rod in said one direction into pivoting movement of the other latch in a sense opposite from said one sense from its hasp-engaging position to its hasp-disengaging position, whereby the latches are pivoted in unison in opposite senses by lengthwise movement of the slide rod in said one direction.

15. A latch console as defined in claim 14, wherein each of said latches is in the form of a crank including a mounting section, a hasp-engaging section and an actuating section, the actuating section including a cam surface adapted to cooperate with a complementary cam surface on the slide rod for moving the latch from the hasp-engaging to the hasp-disengaging position.

16. A latch console as defined in claim 14, wherein the latches are mounted for movement from their hasp-engaging to their hasp-disengaging positions independently of the slide rod.

17. A latch console as defined in claim 14, including spring means biasing the latches toward their hasp-engaging positions.

18. A latch console as defined in claim 14, including a cover plate, and an actuator assembly carried on the cover plate, the actuator assembly comprising a manual actuator and a drive member connected with said actuator, the drive member extending into an opening in said slide rod through an elongate slot in said cover plate for moving the slide rod lengthwise in said one direction responsive to codirectional movement of the actuator from a rest position.

19. A latch console as defined in claim 18, wherein the slide rod is reversibly mountable lengthwise on said base plate and the latches can be transposed for operation by lengthwise movement of the slide rod in the opposite direction.

20. A latch console as defined in claim 18, wherein said actuator assembly includes a spring means biasing the actuator to return to the rest position.

21. A latch console as defined in claim 18, including a lock assembly carried on said cover plate, said lock assembly including a movable locking member adapted to enter a lock opening in said slide rod through a corresponding opening in said cover plate to preclude movement of the slide rod by the actuator and control means for moving the locking member into and out of said lock opening.

22. A latch console as defined in claim 21, wherein the lock assembly is separated from the actuator assembly.

23. A latch console as defined in claim 21, wherein the lock assembly comprises a combination lock.

24. A luggage article including first and second sections adapted to be releasably latched together, an elongate latch console extending longitudinally along the interior of a wall of one of said sections, the console including longitudinally spaced latches adapted to engage and disengage complementary hasps on the other section of the article, a first assembly associated with said console and received in a first opening in said wall, the first assembly including a manual latch actuator exposed on the exterior of said wall, a second assembly associated with said console in longitudinally spaced relation to said first assembly, said second assembly being received in a second opening in said wall and including a lock for controlling disengagement of said latches from the associated hasps and lock control means exposed on the exterior of said wall, the article further including means attaching the console to the interior of said wall comprising a first escutcheon plate on the exterior of said wall framing said first opening, and a second escutcheon plate on the exterior of said wall framing said second opening, and means extending through said wall fastening said escutcheon plates to said console.

25. A luggage article latching system including an elongate latch console comprising spaced hasp-engageable and disengageable latches and drive means for operating said latches in unison, an actuator assembly comprising a body member, a manual actuator mounted on said body member, a drive member connected with said actuator, and attachment means on said body member for fastening said body member to said console with said drive member in driving engagement with said drive means, the system further including a lock assembly comprising a further body member having the same outer profile as the body member of said actuator assembly, whereby said assemblies can be received in similar openings in the wall of a luggage article, a locking member and control means for the locking member within said further body member, and further attachment means on said further body member for fastening said further body member to said console with said locking member being adapted to selectively prevent and allow operation of the drive means by the actuator under the influence of the control means.

26. A latching system for a luggage article including an elongate latch console for attachment interiorly to one wall of the article, the console comprising spaced, hasp-engageable and disengageable latches and drive means for operating the latches, an actuator assembly attached to the console for receipt in an opening in said wall, the actuator assembly including a manual actuator for operating the drive means and adapted to be exposed on the exterior of said wall of the article, and attachment means for securing said console in engagement with the interior of said wall with said actuator assembly received in said opening, and a lock assembly on said console for selectively precluding operation of the drive means by said actuator, said lock assembly being adapted to be received in a further opening in said wall, wherein said attachment means includes escutcheon plates adapted to frame said openings of the exterior of said wall and means adapted to extend through said wall and fasten said escutcheon plates to said console.

27. A latching system for a luggage article including an elongate latch console for attachment interiorly to one wall of the article, the console comprising spaced, hasp-engageable and disengageable latches and drive means for operating the latches, an actuator assembly attached to the console for receipt in an opening in said wall, the actuator assembly including a manual actuator for operating the drive means and adapted to be exposed on the exterior of said wall of the article, and attachment means for securing said console in engagement with the interior of said wall with said actuator assembly received in said opening, wherein said attachment means includes brackets adapted to fit on opposite ends of said console respectively and means for fastening said brackets to opposite walls of the article perpendicular to said one wall.

28. A latching system as defined in claim 27, wherein said brackets fit telescopically to the respective ends of the console to permit lengthwise adjustment of the console relative to said opposite walls of the article.

29. For use in a luggage article latching system, a hasp assembly for attachment to one section of the article for cooperation with spaced hasp-engageable and disengageable latches on another section of the article, the assembly including an elongate rod, a pair of fixed hasps depending from said rod in spaced relation lengthwise of the rod and means for attaching said rod interiorly to one wall of said section of the article, wherein the attaching means includes brackets adapted to fit on opposite ends of the rod and means for fastening said brackets to opposite walls of said one section of the article perpendicular to said one wall.

30. An assembly as defined in claim 29, wherein the brackets fit the ends of the rod telescopically to permit lengthwise adjustment of the rod with respect to said opposite walls.

31. An assembly as defined in claim 29, wherein the hasps are integral with the rod.

32. A luggage article latching system including an elongate substantially planar latch console comprising, as a unitary structure, a baseplate, a cover plate attached to the baseplate, a pair of longitudinally spaced hasp-engageable and disengagable latches between said plates, drive means between said plates for moving said latches from hasp-engaging to hasp-disengaging positions, an actuator assembly fixed to said cover plate and including a movable manual actuator and a drive member connecting said actuator to said drive means through a slot in said cover plate, and lock means for preventing or allowing actuator-initiated movement of said drive means via said drive member, and attachment means for securing said console as a unit in engagement with the interior of a wall of a luggage article and with the actuator and the lock means accessible from the exterior of said wall, wherein said lock means is a further assembly mounted on said cover plate in spaced relation to said actuator assembly and wherein said lock means includes a movable locking member insertable through a corresponding opening in said cover plate to engage said drive means for blocking movement of the same.

33. A latching system as defined in claim 32, wherein said lock means comprises a combination lock having a pivotal bolt consistuting said movable locking member.

34. A luggage article latching system including an elongate substantially planar latch console comprising, as a unitary structure, a baseplate, a cover plate attached to the baseplate, a pair of longitudinally spaced hasp-engageable and disenageable latches between said plates, drive means between said plates for moving said latches from hasp-engaging to hasp-disengaging positions, an actuator assembly including a body member and a movable manual actuator mounted on said body member, said actuator assembly being a structure separate from said cover plate and having means for mounting the actuator assembly on the exterior of said cover plate selectively in alternate locations, said actuator assembly having a drive member connecting said manual actuator to said drive means through means slot in said cover plate at said locations and having lock means for preventing or allowing actuator-initiated movement of said drive means via said drive member, and attachment means for securing said console as a unit in engagement with the interior of a wall of a luggage article and with the actuator and the lock means accessible from the exterior of said wall.

35. A latching system as defined in claim 34, wherein said lock means is part of said actuator assembly.

36. A latching system as defined in claim 35, wherein said lock means comprises a combination lock mounted on said body member of said actuator assembly and having a plurality of dials exposed through openings in said body member, said combination lock controlling the ability of said manual actuator to move said drive means via said drive member.

37. A latching system as defined in claim 34, wherein said latches are disposed at opposite ends of said elongate substantially planar latch console and said drive means comprises latch operating means movable along the length of said console.

38. A latching system as defined in claim 37, wherein said manual actuator is supported on said body member of said actuator assembly for movement parallel to said cover plate of said console and wherein said drive member moves said drive means longitudinally of said console in response to said movement of said manual actuator.

* * * * *

UNITED STATES PATENT AND TRADEMARK OFFICE

CERTIFICATE OF CORRECTION

PATENT NO. : 4,677,832

DATED : July 7, 1987

INVENTOR(S) : Richard Charles REMINGTON

It is certified that error appears in the above-identified patent and that said Letters Patent is hereby corrected as shown below:

On page 1 of the patent, the Assignee should read
-- Presto Lock, Inc., Garfield, New Jersey --

Signed and Sealed this

Twenty-seventh Day of October, 1987

*Attest:*

DONALD J. QUIGG

*Attesting Officer*

*Commissioner of Patents and Trademarks*